US011208822B2

(12) United States Patent
Doan et al.

(10) Patent No.: US 11,208,822 B2
(45) Date of Patent: Dec. 28, 2021

(54) SYSTEMS AND METHODS FOR MAINTAINING POOL SYSTEMS

(71) Applicant: Poolside Tech, LLC, New Hope, PA (US)

(72) Inventors: William R. Doan, New Hope, PA (US); Stan Reznik, Riverwoods, IL (US); Calvin Irwin, Cambridge (CA)

(73) Assignee: Poolside Tech, LLC, New Hope, PA (US)

( * ) Notice: Subject to any disclaimer, the term of this patent is extended or adjusted under 35 U.S.C. 154(b) by 0 days.

(21) Appl. No.: 17/209,929

(22) Filed: Mar. 23, 2021

(65) Prior Publication Data

US 2021/0340785 A1 Nov. 4, 2021

Related U.S. Application Data

(60) Provisional application No. 63/019,004, filed on May 1, 2020.

(51) Int. Cl.
*E04H 4/12* (2006.01)

(52) U.S. Cl.
CPC ..... *E04H 4/1245* (2013.01); *E04H 4/129* (2013.01); *E04H 4/1227* (2013.01); *E04H 4/1236* (2013.01)

(58) Field of Classification Search
CPC ..... E04H 4/1245; E04H 4/129; E04H 4/1227; E04H 4/1236
USPC ..... 4/490, 507–509
See application file for complete search history.

(56) References Cited

U.S. PATENT DOCUMENTS

| | | | |
|---|---|---|---|
| 3,819,297 | A | 6/1974 | East |
| 4,090,532 | A | 5/1978 | Story |
| 4,322,297 | A | 3/1982 | Bajka |
| 5,483,227 | A | 1/1996 | Kuo et al. |
| 6,670,584 | B1 | 12/2003 | Azizeh |
| 7,931,447 | B2 | 4/2011 | Levin et al. |

(Continued)

FOREIGN PATENT DOCUMENTS

WO 2021050932 A1 3/2021

OTHER PUBLICATIONS

International Search Report and Written Opinion, International Patent Application No. PCT/US2021/026576, dated Jun. 22, 2021.

*Primary Examiner* — Tuan N Nguyen
(74) *Attorney, Agent, or Firm* — Saul Ewing Arnstein & Lehr LLP; Brian R. Landry; Paul A. Leicht

(57) ABSTRACT

One aspect of the invention provides a system including: a liquid filter configured for fluidic communication with a fluid repository; a flow sensor in fluidic communication with the liquid filter; a variable-speed pump in fluidic communication with the liquid filter and the flow sensor; and a processor in electronic communication with the flow sensor and the variable-speed pump. The processor is configured to: determine a total volume threshold for a filtration procedure of the fluid repository; identify a set of fluid flow activities performed by the variable-speed pump; determine a remaining volume for completing the filtration procedure by reducing the total volume threshold by a volume of fluid moved by the variable-speed pump during the set of fluid flow activities; and determine, from a set of energy-expenditure factors and the remaining volume, an activation schedule and an activation power output of the variable-speed pump for completing the filtration procedure.

18 Claims, 3 Drawing Sheets

(56) References Cited

U.S. PATENT DOCUMENTS

| | | | | |
|---|---|---|---|---|
| 8,131,497 | B2 | 3/2012 | Steinberg et al. | |
| 8,313,305 | B2 | 11/2012 | Bevington | |
| 8,800,473 | B1 | 8/2014 | Deverse et al. | |
| 9,031,702 | B2 | 5/2015 | Pruchniewski et al. | |
| 10,219,975 | B2 | 3/2019 | Potucek et al. | |
| 2003/0163865 | A1 | 9/2003 | Huang | |
| 2004/0230344 | A1 | 11/2004 | Gallupe et al. | |
| 2005/0222786 | A1 | 10/2005 | Tarpo et al. | |
| 2006/0272830 | A1 | 12/2006 | Fima | |
| 2007/0154319 | A1* | 7/2007 | Stiles, Jr. ..... | F04B 49/06 417/42 |
| 2008/0078100 | A1 | 4/2008 | Kim et al. | |
| 2008/0148592 | A1 | 6/2008 | Kim et al. | |
| 2008/0313921 | A1 | 12/2008 | Oh et al. | |
| 2008/0313923 | A1 | 12/2008 | Oh et al. | |
| 2009/0139110 | A1 | 6/2009 | Oh et al. | |
| 2009/0151801 | A1 | 6/2009 | Gorman et al. | |
| 2009/0204263 | A1 | 8/2009 | Love | |
| 2011/0315262 | A1 | 12/2011 | Butler et al. | |
| 2012/0073040 | A1 | 3/2012 | Cohen | |
| 2012/0123594 | A1 | 5/2012 | Finch et al. | |
| 2013/0327403 | A1 | 12/2013 | Jensen | |
| 2014/0305525 | A1 | 10/2014 | Moing et al. | |
| 2015/0107675 | A1 | 4/2015 | Kucera | |
| 2015/0278930 | A1 | 10/2015 | Potucek et al. | |
| 2016/0153456 | A1 | 6/2016 | Stiles et al. | |
| 2017/0209338 | A1* | 7/2017 | Potucek ..... | E04H 4/1245 |
| 2018/0240322 | A1 | 8/2018 | Potucek et al. | |
| 2019/0204203 | A1 | 7/2019 | Nix | |
| 2019/0331363 | A1 | 10/2019 | Peng et al. | |
| 2020/0319621 | A1 | 10/2020 | Roy et al. | |
| 2021/0047853 | A1* | 2/2021 | Gamboa ..... | E04H 4/1245 |

* cited by examiner

SYSTEMS AND METHODS FOR MAINTAINING POOL SYSTEMS

CROSS-REFERENCE TO RELATED APPLICATION

This application claims the benefit of priority under 35 U.S.C. § 119(e) to U.S. Provisional Patent Application Ser. No. 63/019,004, filed May 1, 2020. The entire content of this application is hereby incorporated by reference herein.

BACKGROUND OF THE INVENTION

Pool systems (e.g., swimming pools, hot tubs, spas, and the like) typically include maintenance systems for cleaning the pool water, such as a liquid filtration system, debris traps, heating elements, and the like. However, these maintenance systems are operated inefficiently, such that the systems expend more energy and costs more to operate than required to effectively clean the pool system.

SUMMARY OF THE INVENTION

One aspect of the invention provides a system including: a liquid filter configured for fluidic communication with a fluid repository; a flow sensor in fluidic communication with the liquid filter; a variable-speed pump in fluidic communication with the liquid filter and the flow sensor; and a processor in electronic communication with the flow sensor and the variable-speed pump. The processor is configured to: determine a total volume threshold for a filtration procedure of the fluid repository; identify a set of fluid flow activities performed by the variable-speed pump; determine a remaining volume for completing the filtration procedure by reducing the total volume threshold by a volume of fluid moved by the variable-speed pump during the set of fluid flow activities; and determine, from a set of energy-expenditure factors and the remaining volume, an activation schedule and an activation power output of the variable-speed pump for completing the filtration procedure.

This aspect of the invention can have a variety of embodiments. The processor can be further configured to activate the variable-speed pump according to the activation schedule and the activation power output.

The set of energy-expenditure factors can further include at least a schedule of daily energy rates, wherein the processor is further configured to receive the schedule of daily energy rates. The processor can be further configured to identify a time period corresponding to a minimum energy rate, and the activation schedule can be determined according to the time period.

The set of energy-expenditure factors can further include at least an affinity curve of the variable-speed pump. The processor can be further configured to identify a maximum power output efficiency of the variable-speed pump from the affinity curve, and wherein the processor is further configured to identify the activation power output according to the maximum power output efficiency.

The processor can be further configured to execute the filtration procedure within a predefined time span. The processor can be further configured to identify an expiration time of the predefined time span, and wherein the activation schedule and activation power output is revised according to the expiration time. The activation schedule can further include a set of run times for the variable-speed pump within the predefined time span. The activation power output can further include a set of power output values for the variable-speed pump.

The processor can be further configured to identify a pattern of heating procedures conducted by a heating element in fluidic communication with the fluid filter and the variable-speed pump, wherein the set of energy-expenditure factors comprises at least the pattern of heating procedures.

The system can further include another fluid filter configured for fluidic communication with the fluid repository, wherein the set of energy-expenditure factors comprises at least an operating condition of the other fluid filter. The processor can be further configured to: identify which of the fluid filter and the other fluid filter is less obstructed; and control one or more valves to pump fluid through which of the fluid filter and the other fluid filter is less obstructed.

The set of energy-expenditure factors can include at least a predefined energy-rate threshold, wherein the processor is further configured to: determine an energy rate for the system exceeds the predefined energy-rate threshold during execution of the filtration procedure; and suspend the filtration procedure due to the exceeded energy rate.

The set of energy-expenditure factors can further include at least a vacuuming system in fluidic communication with the variable-speed pump, wherein the processor is further configured to: determine an operating procedure of the vacuuming system; and adjust the activation schedule and activation power output of the variable-speed pump according to a water volume flowing through the vacuuming system during the operating procedure.

The set of energy-expenditure factors can further include at least a weather forecast, wherein the processor is further configured to: receive an electronic forecast report; determine a forecasted amount of rain to accumulate during a time period required to complete the filtration procedure; and modify the activation schedule of the variable-speed pump based on the forecasted rain accumulation.

The set of energy-expenditure factors can include at least a water-feature system in fluidic communication with variable-speed pump and the fluid filter, wherein the processor is further configured to: determine an operating procedure of the water-feature system; and modify the activation schedule according to a water volume flowing through the water-feature system during the operating procedure.

The set of energy-expenditure factors can include at least an operating condition of the fluid filter, wherein the processor is further configured to: identify the operating condition of the fluid filter; and adjust the activation power output of the variable speed filter according to a degradation of the operation condition of the fluid filter.

The processor can be further configured to: detect that the liquid filter is obstructed; and activate the variable-speed pump to a higher speed to compensate for the obstruction.

BRIEF DESCRIPTION OF THE DRAWINGS

For a fuller understanding of the nature and desired objects of the present invention, reference is made to the following detailed description taken in conjunction with the accompanying drawing figures wherein like reference characters denote corresponding parts throughout the several views.

DEFINITIONS

Figure 1:
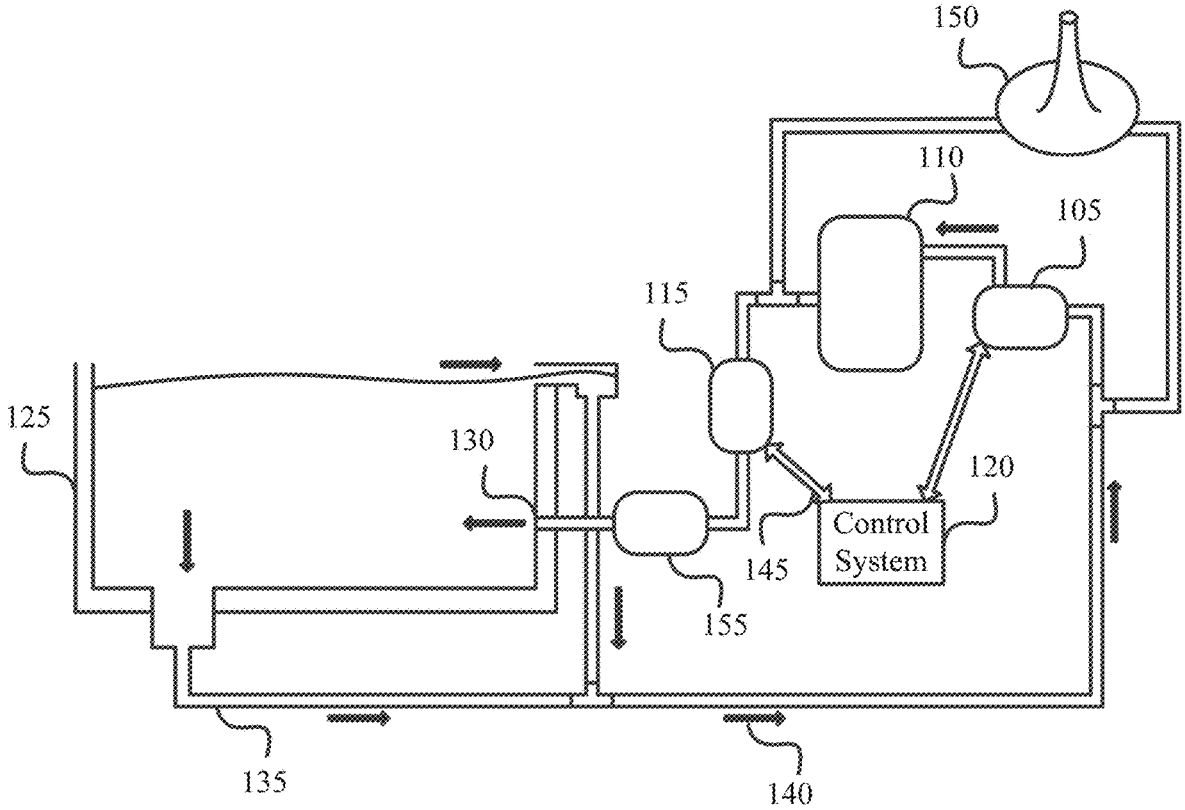
FIG. 1 depicts a maintenance system for a pool according to embodiments of the claimed invention.

The instant invention is most clearly understood with reference to the following definitions.

As used herein, the singular form "a," "an," and "the" include plural references unless the context clearly dictates otherwise.

Unless specifically stated or obvious from context, as used herein, the term "about" is understood as within a range of normal tolerance in the art, for example within 2 standard deviations of the mean. "About" can be understood as within 10%, 9%, 8%, 7%, 6%, 5%, 4%, 3%, 2%, 1%, 0.5%, 0.1%, 0.05%, or 0.01% of the stated value. Unless otherwise clear from context, all numerical values provided herein are modified by the term about.

As used in the specification and claims, the terms "comprises," "comprising," "containing," "having," and the like can have the meaning ascribed to them in U.S. patent law and can mean "includes," "including," and the like.

Unless specifically stated or obvious from context, the term "or," as used herein, is understood to be inclusive.

Ranges provided herein are understood to be shorthand for all of the values within the range. For example, a range of 1 to 50 is understood to include any number, combination of numbers, or sub-range from the group consisting 1, 2, 3, 4, 5, 6, 7, 8, 9, 10, 11, 12, 13, 14, 15, 16, 17, 18, 19, 20, 21, 22, 23, 24, 25, 26, 27, 28, 29, 30, 31, 32, 33, 34, 35, 36, 37, 38, 39, 40, 41, 42, 43, 44, 45, 46, 47, 48, 49, or 50 (as well as fractions thereof unless the context clearly dictates otherwise).

DETAILED DESCRIPTION OF THE INVENTION

Maintenance System

Methods and systems described herein relate to generating a filtration schedule for a pool maintenance system. Aqualiesure-associated bodies of water can include filtering procedures in order to maintain a safe and pleasant environment for pool and spa users. Conventional techniques and systems for performing fluid filtration are typically based on static approximations of water volume and filtration capacity. A significant amount of energy can be wasted due to fluid-flow pumps of the maintenance system running too long. A typical maintenance system using a timer-based pump schedule is likely to run too long or at too high speed in the following situations: where fluid flow pumps are active due to earlier heating demands and where a pump schedule is created without appropriate calculation of flow rates and fluid volume required to be filtered.

The techniques and systems described herein relate to the generation of a filtration schedule that minimizes energy use and maximizes cost savings. A maintenance system for a pool or other fluid repository can calculate daily fluid filter pump run time schedules by combining a known body of fluid volume and user-desired run times with the flow rate of the fluid flow pump to determine the optimal run time and speed. The system can also utilize cost-optimization factors, such as time-of-use energy rates provided by the user, the system, and/or a third party such as a utility provider. In some cases, the system can retrieve on-demand energy rates where available.

Pump efficiency curves and time-of-use energy costs can be factored into the scheduling calculation in order to run the pump at its most-efficient rate and cost. Most fluid-flow pumps do not feature a linear performance curve, meaning that operating at less than 100% power is likely to result in higher energy efficiency. Additional inputs can also be taken into consideration when available to determine precise flow rates produced by the pump. Fluid-flow rate can be determined using dedicated flow-rate sensors, flow-rate approximations using flow switches or user-entered pipe resistance (e.g., as measured in feet of head).

Fluid-Flow Pump

FIG. 1 depicts a maintenance system for a fluid repository in accordance with an embodiment of the claimed invention. The maintenance system can include a fluid flow pump 105. The pump, when activated, can flow water or other fluid through the maintenance system. In some cases, the fluid-flow pump 105 can be a single-stage pump that operates at a static power output and/or rotational speed (e.g., in rpm). In other cases, the fluid flow pump can be a variable-speed pump. In these cases, the pump can be activated at variable flow rates. For example, a controller or control system can manage the rotations per minute (rpm) of a pump motor, which can be directly correlated to the power output of the pump. Additionally, as the pump can include a maximum rpm or power output, a controller or control system can activate the pump at rpm and/or power fractions of the pump's maximum output. Examples of variable-speed pumps can include, but are not limited to, HAYWARD ECOSTAR, HAYWARD TRISTAR, JANDY EPUMP, PENTAIR INTELLIFLO VS, and the like.

Flow-Rate Sensor

The maintenance system can also include a flow-rate sensor 115. The flow rate sensor 115 can be in fluidic communication with the fluid flow pump 105, for example via a fluid channel such as piping. The flow rate sensor 115 can receive flow rate measurement signals of a fluid flowing to the flow rate sensor 115. In some cases, the flow-rate sensor 115 can be "downstream" of the fluid flow pump 105, such that fluid flowing from the pump 105 can flow towards the flow rate sensor 115.

In some cases, the flow rate sensor 115 can include "smart" sensors, such as a flow-rate turbine or a piezo-electric flow meter. In the case of a flow-rate turbine, the turbine can be pushed by fluid flowing through the fluid channel or pipe. The pushed turbine can generate an electric current or signal based on the speed of the fluid flow, where a processor can then identify the flow rate from the amount of electricity generated. In the case of piezo-electric flow meters, flow rate can be determined through measuring the Doppler effect and/or propagation time of ultrasonic waves generated by the flow meter. In any of these smart flow rate sensor cases, the flow rate sensor may be coupled to an intermediary processor, which can process received measurements and signals to generate flow rate values and the like. This intermediary processor can communicate electronically to the controller or control system of the pool maintenance system.

In some cases, the flow rate sensor 115 can include a minimal flow-rate registration threshold. For example, the flow rate sensor 115 can include a flow switch. The flow switch can include a paddle positioned within the fluid channel. When the flow rate sensor experiences a sufficient flow rate of the flowing fluid, the paddle is "pushed" or deflected by the flowing fluid. An electronic circuit can be completed (e.g., closed) when the paddle is in the pushed or deflected position, and can be open otherwise. The closed circuit can transmit an electrical communication to a controller or control system, such that the controller or control system can determine when a fluid flow rate exceeds the flow rate sensor's minimal flow rate registration threshold. Likewise, the controller or control system can determine when the fluid flow rate falls below the minimal flow rate registration threshold, as the controller or control system can determine that the system has not received an electrical communication from the flow rate sensor. Examples of flow rate sensors can include, but are not limited to, HAYWARD GLX-FLO-RP, HAYWARD AQUARITE, PENTAIR ITELLICHLOR, JANDY AQUAPURE, and the like.

Fluid Filter

The maintenance system can also include a fluid filter 110. The fluid filter 110 can filter particles, debris, and the like, from a fluid flowing through the maintenance system. Examples of fluid filters of the maintenance system can include, but are not limited to HAYWARD PRO SERIES, HAYWARD SWIMCLEAR, JANDY PRO SERIES CV, JANDY CL CARTRIDGE FILTER, PENTAIR CLEAN and CLEAR PLUS, PENTAIR EASY CLEAN, and the like.

Control System

Figure 2:
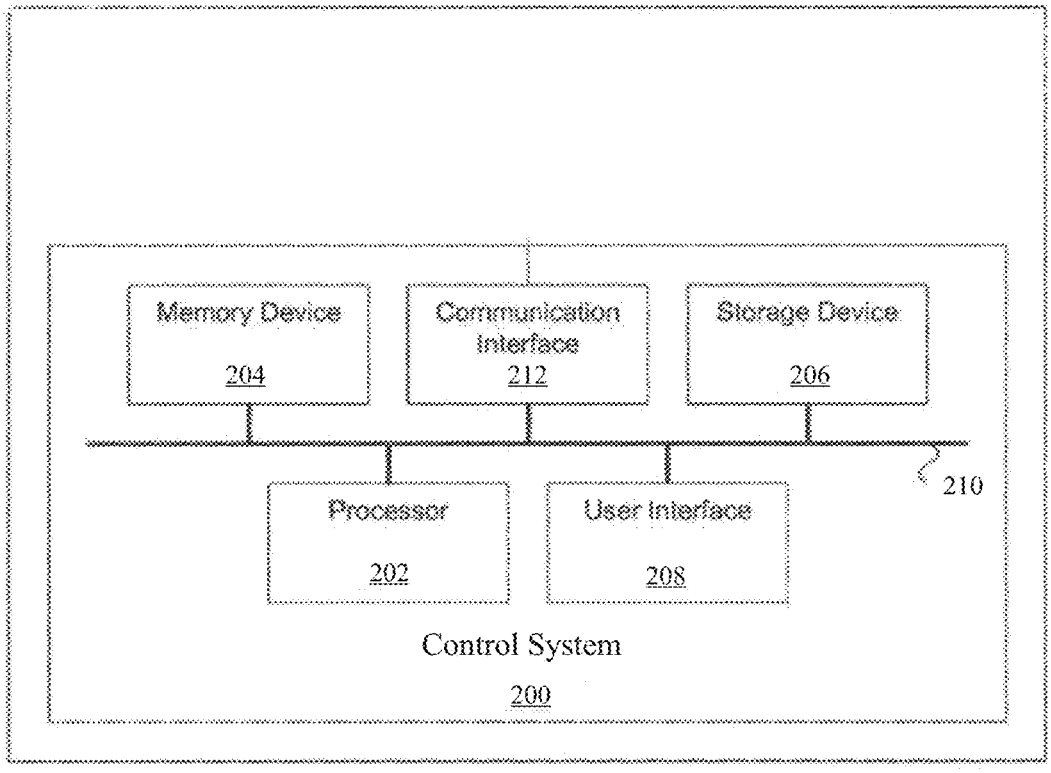
FIG. 2 depicts a control system according to embodiments of the claimed invention.

The maintenance system can also include a control system 120. For example, a control system 200 is depicted in FIG. 2. The control system can be in electronic communication with the variable-speed pump and the flow rate sensor. In some cases, the control system can transmit activation communications to the variable-speed pump, such as a percentage of maximum power output or rpms for the pump to operate under. Further, the control system can, in some cases, receive notification communications from the pump, the flow rate sensor, or both. For example, the pump can transmit communications notifying the control system of the pump activating at a given power output or rpm. The flow rate sensor can transmit flow rate communications to the control system, such as when the flow rate sensor is in a deflected or pushed position.

The control system 120 can be an electronic device programmed to control the operation of the maintenance system to achieve a desired result. The control system 120 can be programmed to autonomously carry out a system performance status regimen without the need for input (either from feedback devices or users) or can incorporate such inputs. The principles of how to use feedback (e.g., from a flow rate sensor) in order to modulate operation of a component are described, for example, in Karl Johan Astrom & Richard M. Murray, *Feedback Systems: An Introduction for Scientists & Engineers* (2008).

The control system 120 can be a computing device such as a microcontroller (e.g., available under the ARDUINO® OR IOIO™ trademarks), general purpose computer (e.g., a personal computer or PC), workstation, mainframe computer system, and so forth. An exemplary control system is illustrated in FIG. 2. The control system ("control unit") 200 can include a processor device (e.g., a central processing unit or "CPU") 202, a memory device 204, a storage device 206, a user interface 208, a system bus 210, and a communication interface 212.

The processor 202 can be any type of processing device for carrying out instructions, processing data, and so forth.

The memory device 204 can be any type of memory device including any one or more of random access memory ("RAM"), read-only memory ("ROM"), Flash memory, Electrically Erasable Programmable Read Only Memory ("EEPROM"), and so forth.

The storage device 206 can be any data storage device for reading/writing from/to any removable and/or integrated optical, magnetic, and/or optical-magneto storage medium, and the like (e.g., a hard disk, a compact disc-read-only memory "CD-ROM", CD-ReWritable CDRW," Digital Versatile Disc-ROM "DVD-ROM", DVD-RW, and so forth). The storage device 206 can also include a controller/interface for connecting to the system bus 210. Thus, the memory device 204 and the storage device 206 are suitable for storing data as well as instructions for programmed processes for execution on the processor 202.

The user interface 208 can include a touch screen, control panel, keyboard, keypad, display or any other type of interface, which can be connected to the system bus 210 through a corresponding input/output device interface/adapter.

The communication interface 212 can be adapted and configured to communicate with any type of external device, or with other components of the pool maintenance system. For example, double-lined arrows, such as the arrow 145, can illustrate electronic communication between the control system 120 of FIG. 1 and another component of the pool maintenance system (e.g., the variable-speed pump 105). The communication interface 212 can further be adapted and configured to communicate with any system or network, such as one or more computing devices on a local area network ("LAN"), wide area network ("WAN"), the Internet, and so forth. The communication interface 212 can be connected directly to the system bus 210 or can be connected through a suitable interface.

The control system 200 can, thus, provide for executing processes, by itself and/or in cooperation with one or more additional devices, that can include algorithms for controlling components of the pool maintenance system in accordance with the claimed invention. The control system 200 can be programmed or instructed to perform these processes according to any communication protocol and/or programming language on any platform. Thus, the processes can be embodied in data as well as instructions stored in the memory device 204 and/or storage device 206, or received at the user interface 208 and/or communication interface 212 for execution on the processor 202.

Fluid Heater/Cooler

The pool maintenance system can also include fluid heater/coolers 155. The heater/cooler 155 can be fluidically coupled to the flow pump 105 and can be configured to be fluidically coupled to the fluid repository 125. Further, the heater/cooler 155 can be in electronic communication with the control system 120. When activated, the heater/cooler 155 can alter the temperature of the fluid flowing through the heater/cooler 155.

The heater/cooler 155 can rely on a variety of energy sources. For example, the heater/cooler can be an electric heater or cooler, where the heat source is electrical. In some examples, the heater/cooler can be a natural gas heater, where the heat source is gas. In yet other examples, the heater/cooler can be a solar heater, where the heat source is solar. Further, the pool maintenance system can include a variety of heaters and/or coolers, where each heater and cooler is fluidically coupled to the fluid flow pump and configured to be coupled to a fluid repository.

Water Feature(s)

The maintenance system can also include a water feature 150. In some cases, the water feature 150 can include an aesthetic item, such as a water fountain or the like. Additionally or alternatively, the water feature 150 can include an item with a maintenance function, such as a pool cleaner and the like. The water feature can be in fluidic communication with the fluid flow pump 105, in electronic communication with the control system 120, or both. In some cases, fluid flow to and from the water feature can be controlled by the control system 120 either directly (e.g., activating the fluid feature), or indirectly (e.g., activating the fluid flow pump and directing fluid flow to the fluid feature via valves, etc.).

Pool Basin

The maintenance system can be coupled to a liquid repository 125, such as a pool basin, a spa basin, a hot tub basin, and the like. The coupling can be via fluidic channels, such as water piping and the like. Further, the dimensions and geometrical shapes of a coupled basin can vary, and one skilled in the art would understand different basin configurations can be coupled to the maintenance system.

In some cases, the maintenance system can be configured to couple to the fluid repository via an intake and outtake channels (e.g., channels 130 and 135). For example, fluid channels can couple the fluid repository to the fluid filter, and fluid channels can couple the fluid repository to the flow rate sensor and/or the variable-speed pump. Yet in some cases, the maintenance system can be fluidically coupled to the fluid repository in a recycling configuration, such that fluid is recycled from the fluid repository, through the maintenance system, and back to the fluid repository.

Energy Expenditure Parameters

Figure 3:
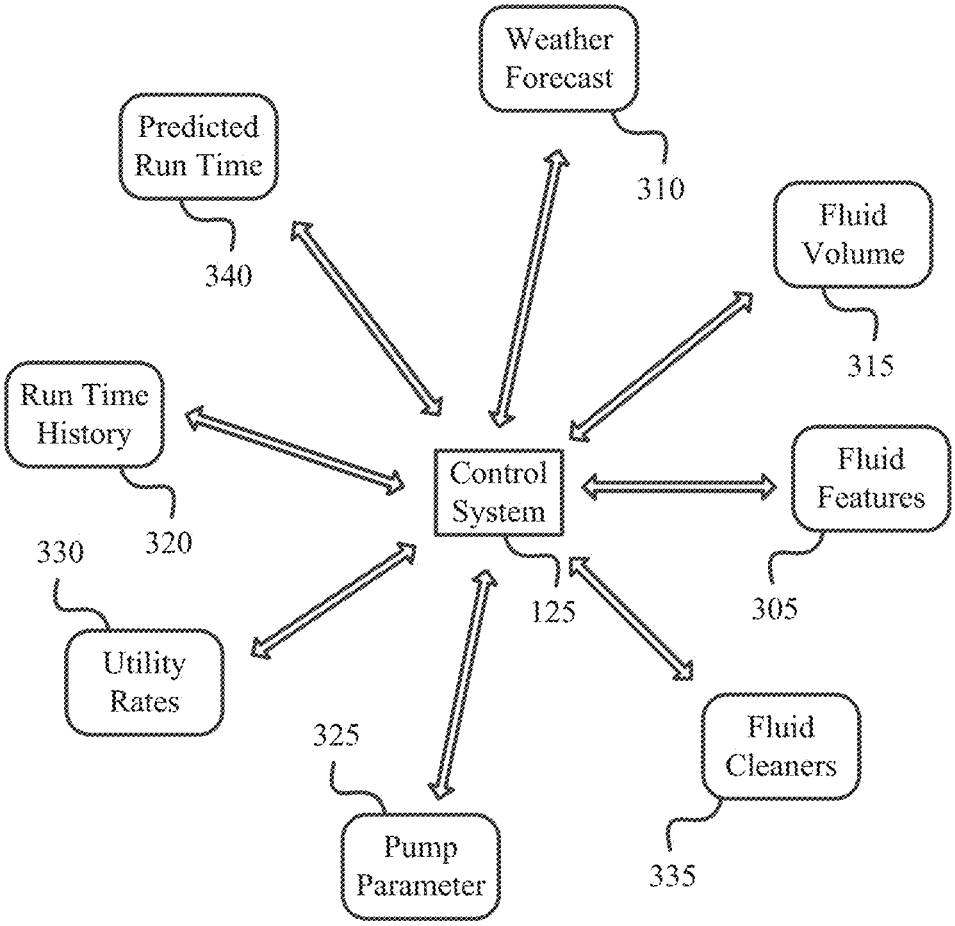
FIG. 3 depicts a set of energy-expenditure factors for generating a filtration procedure according to an embodiment of the claimed invention.

The control system can monitor various parameters that affect energy expenditure, and associated costs, for maintaining a fluid volume contained by a fluid repository. Further, FIG. 3 depicts the various parameters that the control system can monitor. These various parameters are discussed in more detail below.

Water Features

The control system can identify one or more water features coupled to the pool maintenance system (e.g., water features 305). Water features can include items that affect different fluid parameters of the fluid volume contained by the fluid repository, such as heaters, chillers, and the like. In some cases, a water features can add aesthetic value, for example with fountains and the like. In some cases, the identification of a water feature can be accomplished by the system receiving user input, such as a make and model number of a heater.

The system can also identify performance parameters of a water feature. For example, the system can receive information corresponding to power output, thermal conductivity rates, etc., of a respective heater. These parameters may be stored previously by the system (e.g., via a spreadsheet at the time of manufacture), or in some cases, the system can retrieve these parameters electronically (e.g., through a website, web service, XML feed, and the like).

Fluid Cleaners

The control system can also identify fluid cleaners coupled to the system (e.g., fluid cleaners 335). Fluid cleaners can clean the fluid volume and/or the pool basin, and can be in fluidic communication with the fluid flow pump, in electronic communication with the control system, or both. Fluid cleaners can include robotic pool cleaners, suction pool cleaners, pressure pool cleaners, and the like. Identification can occur through manual input (e.g., a user input make and model information, etc.), or the control system can be in electronic communication with the fluid cleaner and can receive electronically identification information from the pool cleaner. Further, the control system can identify other characteristics of the pool cleaner, such as required flow rate, power expenditure, and the like.

Weather Forecast

The control system can also monitor weather forecasts pertaining to a coupled fluid repository (e.g., weather forecast 310). For example, the control system can be in electronic communication with a weather forecast reporting system (e.g., the National Weather Service, Weather.com®, and the like). Based on the geographical location of the coupled fluid repository (e.g., determined by GPS, IP address, user input, etc.), the maintenance system can receive (e.g., hourly, daily, etc.) a weather forecast for the fluid repository. The forecast can include metrics such as air temperature, humidity levels, probability of precipitation, wind speed, anticipated solar radiation levels, and the like. The maintenance system can store these weather metrics for future analysis.

Fluid Volume

The maintenance system can determine a total volume of the fluid contained by a coupled fluid repository (e.g., fluid volume 315). For example, the control system can determine the fluid volume by user input, such as an estimated fluid volume and/or dimensions of the coupled fluid repository. In some cases, the control system can monitor how long it takes for the fluid volume to increase or decrease to a predefined temperature threshold, and based on thermal conductivity parameters of the corresponding heater or chiller, calculate the fluid volume. In some cases, the control system can adjust the fluid volume based on environmental factors, such as rain accumulation and evaporation (e.g., from a weather forecast).

Run Time History

The control system can determine a run-time history for the fluid flow pump (e.g., run-time history 320). For example, the control system can store fluid pump activation times. In some cases, the control system can calculate times of operation for water features. In some cases, the control system can also monitor run time histories for the water features coupled to the pool maintenance system. For example, run-time histories can include heating or cooling activation periods for the fluid repository, as heating or cooling of the fluid repository can also include activation of the fluid-flow pump. In some cases, the run-time history can include other water features that include fluid flow pump activation (e.g., water fountains and the like).

Predicted Run Time

The pool maintenance system can also determine predicted run times for components of the pool maintenance system (e.g., predicted run time 340). For example, the control system can identify past activation times for the fluid flow pump, heater, fluid feature, and the like. The control system can generate a predicted run time for one or more of the components of the pool maintenance system from these past activation times (e.g., based on activation frequency, activation consistency, and the like). In some cases, the predicted run times can also be based on user input, such as scheduled activation time for components of the pool maintenance system (e.g., running the pool heater at a certain time on a certain day).

Fluid Pump Parameters

The control system can monitor operation parameters for the fluid flow pump (e.g., pump parameters 325). For example, the control system can identify the fluid flow pump of the system. The control system can identify the pump through, for example, user input (e.g., make and model of the pump). The control system can identify operation parameters such as power output, rotations per minute (rpm), affinity curve, energy expenditure rates, and the like, for the pump by searching a stored database, connecting electronically to an online or remote database, or through direct communication with the fluid flow pump. In some cases, the control system can execute a calibration procedure to identify operation parameters for the fluid flow pump.

Utility Rates

The control system can identify utility rates for the components of the system (e.g., utility rates 330). For example, the control system can electronically communicate with a utility rate notification website or service. The control system can receive utility rates for the geographical location which the pool maintenance system is located. The utility rates can be categorized by type of energy (electric, natural gas, and the like), the date, and/or the time of day. In some cases, the control system can store these utility rates for future use.

Filtration Procedure Scheduling Determination

The control system can facilitate the execution of a filtration procedure performed by the maintenance system. The control system can monitor energy-expenditure factors such as those described with reference to FIG. 3 to generate a filtration schedule for a coupled fluid repository. For example, the control system can determine a cost-optimal filtration schedule for cleaning the fluid volume contained by a coupled fluid repository.

The control system can identify a total fluid volume for a filtration schedule. In some cases, the total fluid volume can be the fluid volume contained by the fluid repository. Additionally, the control system can determine a filtration schedule completion time. For example, filtering of a pool may occur on a daily (e.g., every 24 hours) basis. Within each day, the pool maintenance system can filter the total fluid volume through the fluid filter or filters of the pool maintenance system.

The control system can generate the filtration schedule for the total fluid volume based on the total fluid volume and the energy-expenditure factors described above. For example, some activities and component activations perform fluid filtration as an ancillary feature. Activities such as heating a pool and cleaning a pool can include flowing fluid through the fluid filter, and thus an amount of the fluid volume is filtered during these activities. These activities can be taken into account in generating a filtration schedule for the fluid volume.

The control system can also determine a fluid volume that has already been filtered during the filter procedure completion time. For example, the control system can identify that a filtration activity (e.g., heating the pool) occurred earlier in the day. The control system can, from the parameters of the activated components (e.g., flow rate of the fluid flow pump, time of use of the heater, etc.), determine how much of the fluid has already been flowed through the filter. The control system can deduct this volume from the total fluid volume to determine a remaining volume for filtration.

Further, the control system can activate different activities based on their energy-expenditure factors. For example, a user is anticipated to use and heat the coupled pool later in the day. The control system can identify the required fluid flow rate, thermal conductivity parameters, running time, and utility rates for the heater to heat the pool. If multiple heaters are coupled to the pool, the control system can determine a cost-optimal approach, a filtration efficient approach, or both, to heating the pool at the scheduled time.

In some embodiments, the filtration period is set to reflect time-of-use energy rates. For example, if an electrical utility charges off-peak rates from 12:00 AM to 6:00 AM, the filtration period could be set (by algorithm or by configuration) to run from 6:00 AM to 5:59 AM the next day. Such a configuration also coincides with typical human waking hours and can best capture variable pool activities such as water features, cleaning, and heating that may be human- or weather-influenced before "catching-up" on filtration when electricity is the cheapest in the middle of the night and little to no further use is anticipated. Continuing this example, if the system calculates that 4 hours of filtration (at a defined pump speed) are required to filter the full volume of the pool, the heater ran for 1 hour, and a water feature ran for 1 hour, the controller can calculate that 2 further hours of circulation are required to complete filtration and schedule that circulation (e.g., at a low-peak time such as between 4:00 AM and 5:59 AM). Likewise, if activities such heating or water feature usage are anticipated, the controller may defer filtration to rely on circulation from those future events.

The filtration period can additionally or alternatively be dynamic with regard to duration and/or commencement. For example, if one or more components are active through Sunday at 8:00 PM and provide sufficient flow to provide the desired amount of filtration, the controller can begin the next filtration period (e.g., 24 hours) when the components cease to run.

Performance Status Notification

In some cases, the control system can transmit a filtration procedure status notification to a user. For example, the control system can notify a user of an anticipated filtration procedure to be conducted for the fluid volume. The notification can be sent wirelessly, for example, through a user application to a variety of personal computing devices or mobile phones.

Multiple Fluid Repositories

In some cases, the pool maintenance system can be fluidically coupled to more than one fluid repository. For example, the pool maintenance system can be coupled to a pool basin and a spa basin. The control system can generate filtration procedures for each coupled fluid repository. For example, in some cases input fluid channels into each fluid repository can diverge from a single intake channel, and can be individually coupled or decoupled to fluid flow from the variable-speed pump through a channel valve. The control system can be in electronic communication with the channel valve, and can execute activation cycles separately for each of the fluid repositories.

Configurations

The pool maintenance system and techniques described herein can be adaptable to the configurations of existing pool maintenance and fluid repository systems. For example, the control system can be configured to communicate with conventional variable-speed pumps, flow rate sensors, valves, fluid channels, heater/coolers, thermistors, air thermometers, fluid level sensors, and the like. Importantly, some pool maintenance systems can be retrofitted to execute the techniques described herein. For example, many conventional pool systems include a heater, a variable-speed pump, a flow switch, and a pool basin. By implementing the techniques described herein, a pool maintenance system and effectively identify filtration procedures through a new approach, while utilizing hardware already installed for the pool maintenance system. This can significantly decrease costs for pool owners, for example, by eliminating the needs for expensive installation costs and reducing renovation costs, as well as provide the owner with cost-effective techniques for regulating the filtration procedure of a pool, spa, hot tub, and the like.

Further, as shown in the figures and accompanying description, the system and techniques described herein can be adapted to a variety of pool, spa, or other fluid repository systems. While the figures depict specific examples of configurations, one skilled in the art would understand that the maintenance system and associated techniques can be integrated into a multitude of fluid repository systems.

Modulation of Pump Speed to Compensate for Filter Obstructions

Embodiments of the invention can detect that the fluid filter 110 is becoming obstructed (e.g., by leaves or other debris) and increase pump speed to compensate for the obstructions. The degree of increase can be a function of the calculated degree of obstruction. In some embodiments, the degree of increase can be capped and/or increases may only be triggered up to a defined degree of obstruction in order to avoid damage to components if the filter is significantly or completely obstructed. The status of the filter can be assessed using a flow sensor as described herein and/or using the paddle-sensor method described in U.S. Provisional Patent Application Ser. No. 63/011,470, filed Apr. 17, 2020.

EQUIVALENTS

Although preferred embodiments of the invention have been described using specific terms, such description is for illustrative purposes only, and it is to be understood that changes and variations may be made without departing from the spirit or scope of the following claims.

INCORPORATION BY REFERENCE

The entire contents of all patents, published patent applications, and other references cited herein are hereby expressly incorporated herein in their entireties by reference.

The invention claimed is:

1. A system comprising:

a liquid filter configured for fluidic communication with a fluid repository;

a flow sensor in fluidic communication with the liquid filter;

a variable-speed pump in fluidic communication with the liquid filter and the flow sensor; and a processor in electronic communication with the flow sensor and the variable-speed pump, the processor configured to:

determine a total volume threshold for a filtration procedure of the fluid repository;

identify a set of fluid flow activities performed by the variable-speed pump;

determine a remaining volume for completing the filtration procedure by reducing the total volume threshold by a volume of fluid moved by the variable-speed pump during the set of fluid flow activities;

identify a pattern of heating procedures conducted by a heating element in fluidic communication with the liquid filter and the variable-speed pump; and determine, from a set of energy-expenditure factors comprising at least the pattern of heating procedures, and the remaining volume, an activation schedule and an activation power output of the variable-speed pump for completing the filtration procedure.

2. The system of claim 1, wherein the processor is further configured to activate the variable-speed pump according to the activation schedule and the activation power output.

3. The system of claim 1, wherein the set of energy-expenditure factors further comprises at least a schedule of daily energy rates, wherein the processor is further configured to receive the schedule of daily energy rates.

4. The system of claim 3, wherein the processor is further configured to identify a time period corresponding to a minimum energy rate, and wherein the activation schedule is determined according to the time period.

5. The system of claim 1, wherein the set of energy-expenditure factors further comprises at least an affinity curve of the variable-speed pump.

6. The system of claim 5, wherein the processor is further configured to identify a maximum power output efficiency of the variable-speed pump from the affinity curve, and wherein the processor is further configured to identify the activation power output according to the maximum power output efficiency.

7. The system of claim 1, wherein the processor is further configured to execute the filtration procedure within a predefined time span.

8. The system of claim 7, wherein the processor is further configured to identify an expiration time of the predefined time span, and wherein the activation schedule and activation power output is revised according to the expiration time.

9. The system of claim 7, wherein the activation schedule further comprises a set of run times for the variable-speed pump within the predefined time span.

10. The system of claim 7, wherein the activation power output further comprises a set of power output values for the variable-speed pump.

11. The system of claim 1, further comprising:

another liquid filter configured for fluidic communication with the fluid repository, wherein the set of energy-expenditure factors comprises at least an operating condition of the other liquid filter.

12. The system of claim 11, wherein the processor is further configured to:

identify which of the fluid filter and the other liquid filter is less obstructed; and control one or more valves to pump fluid through which of the liquid filter and the other liquid filter is less obstructed.

13. The system of claim 1, wherein the set of energy-expenditure factors comprises at least a predefined energy-rate threshold, wherein the processor is further configured to:

determine an energy rate for the system exceeds the predefined energy-rate threshold during execution of the filtration procedure; and suspend the filtration procedure due to the exceeded energy rate.

14. The system of claim 1, wherein the set of energy-expenditure factors comprises at least a vacuuming system in fluidic communication with the variable-speed pump, wherein the processor is further configured to:

determine an operating procedure of the vacuuming system; and adjust the activation schedule and activation power output of the variable-speed pump according to a water volume flowing through the vacuuming system during the operating procedure.

15. The system of claim 1, wherein the set of energy-expenditure factors comprises at least a weather forecast, wherein the processor is further configured to:

receive an electronic forecast report;

determine a forecasted amount of rain to accumulate during a time period required to complete the filtration procedure; and modify the activation schedule of the variable-speed pump based on the forecasted rain accumulation.

16. The system of claim 1, wherein the set of energy-expenditure factors comprises at least a water-feature system in fluidic communication with variable-speed pump and the liquid filter, wherein the processor is further configured to:

determine an operating procedure of the water-feature system; and modify the activation schedule according to a water volume flowing through the water-feature system during the operating procedure.

17. The system of claim 1, wherein the set of energy-expenditure factors comprises at least an operating condition of the liquid filter, wherein the processor is further configured to:

identify the operating condition of the liquid filter; and adjust the activation power output of the variable speed filter according to a degradation of the operation condition of the liquid filter.

18. The system of claim 1, wherein the processor is further configured to:

detect that the liquid filter is obstructed; and activate the variable-speed pump to a higher speed to compensate for the obstruction.

* * * * *